US006354455B1

(12) United States Patent
Chen

(10) Patent No.: US 6,354,455 B1
(45) Date of Patent: Mar. 12, 2002

(54) CONTAINER BASKET

(75) Inventor: Shyan-Wei Chen, Taipei Hsien (TW)

(73) Assignee: Racer Sporting Goods Co., Ltd., Taipei Hsien (TW)

( * ) Notice: Subject to any disclaimer, the term of this patent is extended or adjusted under 35 U.S.C. 154(b) by 0 days.

(21) Appl. No.: 09/740,837

(22) Filed: Dec. 21, 2000

(51) Int. Cl.[7] ..... B65D 7/24; B65D 7/20
(52) U.S. Cl. ..... 220/489; 220/491; 220/495
(58) Field of Search ..... 220/485, 489, 220/491, 495

(56) References Cited

U.S. PATENT DOCUMENTS 255,488 A * 3/1882 Burroughs ..... 220/495
550,518 A * 11/1895 Marquis ..... 220/495
1,137,698 A * 4/1915 Clark ..... 220/495
1,555,177 A * 9/1925 Barker ..... 220/495
3,072,281 A * 1/1963 Reilly ..... 220/495
4,090,633 A * 5/1978 Trubiano ..... 220/495

* cited by examiner

*Primary Examiner*—Joseph M. Moy
(74) *Attorney, Agent, or Firm*—Varndell & Varndell, PLLC

(57) ABSTRACT

A folding collapsible container basket is constructed to include a rectangular top open frame, a plurality of U-shaped bottom wire rods pivotally connected between two long sides of the top open frame and arranged in parallel, a bottom rack coupled to the U-shaped bottom wire rods, and a handle detachably coupled to the bottom rack. The U-shaped bottom wire rods are turned upwards and closely attached with the bottom rack to the top open frame after disconnection of the handle from the rack, keeping the folding collapsible container basket in a collapsed, flat condition.

1 Claim, 7 Drawing Sheets

CONTAINER BASKET

BACKGROUND AND SUMMARY OF THE INVENTION

The present invention relates to a container basket for carrying bottles and cans and, more particularly to such a container basket, which is folding collapsible.

FIG. 1 shows a container basket for carrying bottles and cans according to the prior art. This structure of container basket comprises a top open frame 61, a plurality of top partition wire rods 62, transversely connected in parallel within the top open frame 61, a handle 5 hooked on the top open frame 61, two first U-shaped bottom wire rods 65 connected in parallel between two short sides of the top open frame 61, three second U-shaped bottom wire rods 66 extended over the first U-shaped bottom wire rods 65 and connected in parallel between two long sides of the top open frame 61, two first connecting rods 63 respectively bilaterally connected between the first U-shaped bottom wire rods 65, and a top hook 64 hinged to the top open frame 61. This structure of container basket occupies much storage space when not in use, because it is not folding collapsible.

The present invention has been accomplished to provide a container basket, which eliminates the aforesaid problem. It is the main object of the present invention to provide a container basket, which is folding collapsible. According to the preferred embodiment of the present invention, the folding collapsible container basket comprises a rectangular top open frame, a plurality of U-shaped bottom wire rods pivotally connected between two long sides of the top open frame and arranged in parallel, a bottom rack coupled to the U-shaped bottom Wire rods, and a handle detachably coupled to the bottom rack. After connection of the handle to the bottom rack, the U-shaped bottom wire rods are positively held in position. When not in use, the handle is disconnected from the bottom rack, enabling the U-shaped bottom wire rods to be turned upwards and closely attached with the bottom rack to the top open frame to set the folding collapsible container basket into a collapsed, flat condition.

DETAILED DESCRIPTION OF THE PREFERRED EMBODIMENT

Figure 1:
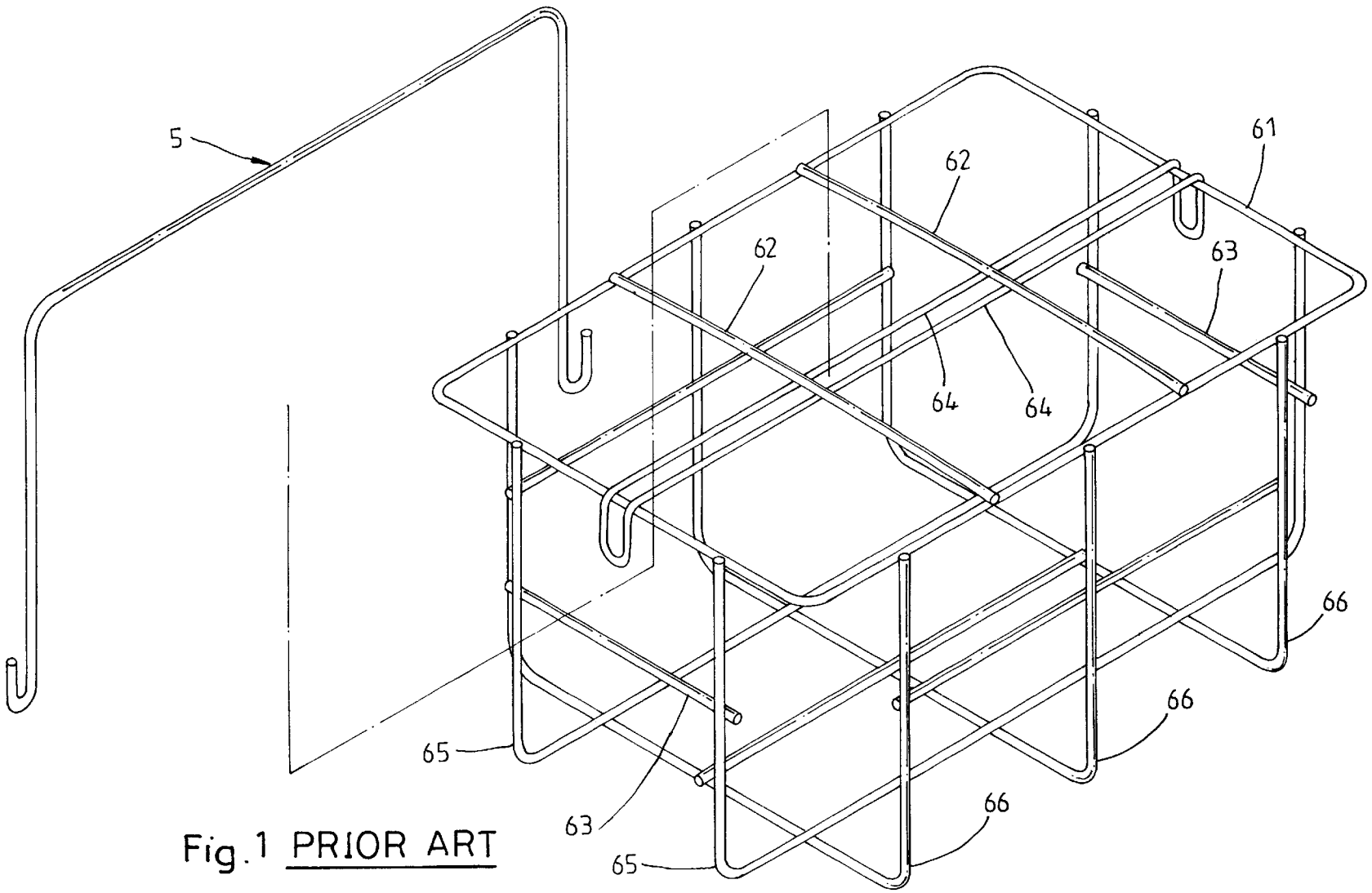
Fig. 1 PRIOR ART
FIG. 1 is an exploded view of a container basket according to the prior art.
Figure 2:
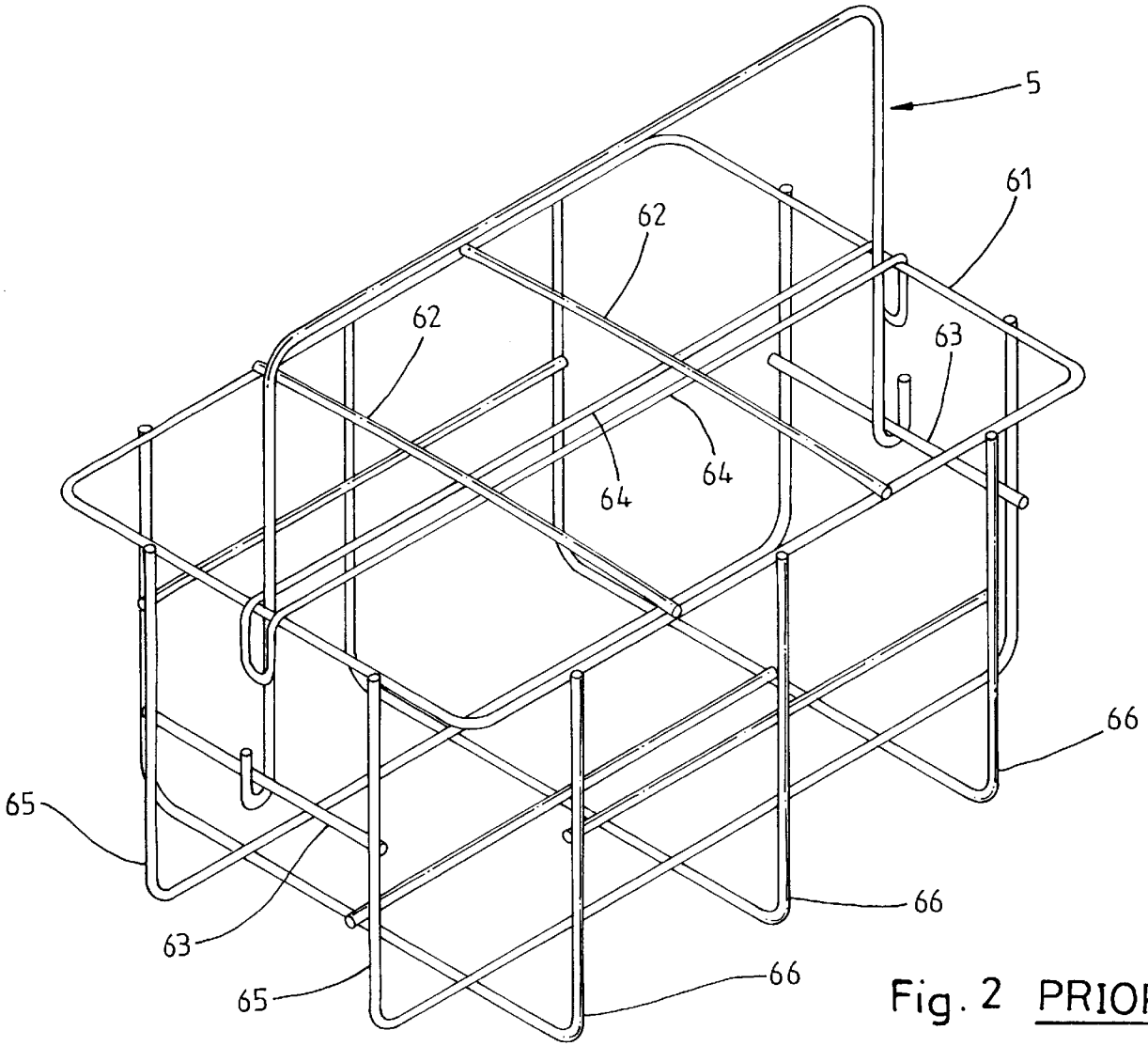
Fig. 2 PRIOR ART
FIG. 2 is a perspective assembly view of the container basket shown in FIG. 1.
Figure 3:
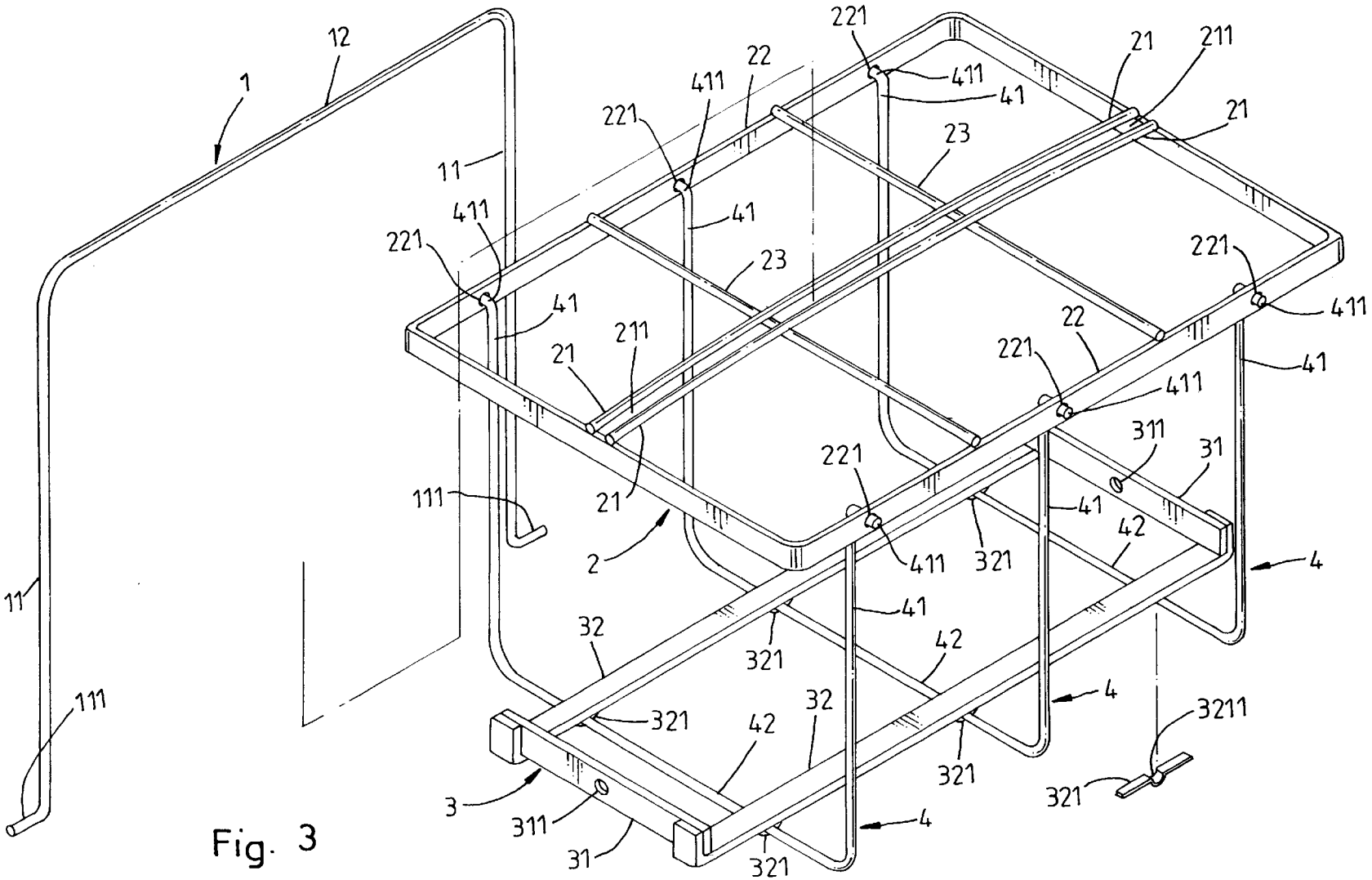
FIG. 3 is an exploded view of a folding collapsible container basket according to the present invention.

Referring to FIG. 3, a folding collapsible container basket in accordance with the present invention is generally comprised of a handle 1, a top open frame 2, a plurality of bottom rack 3, and a plurality of U-shaped bottom wire rods 4.

Figure 4:
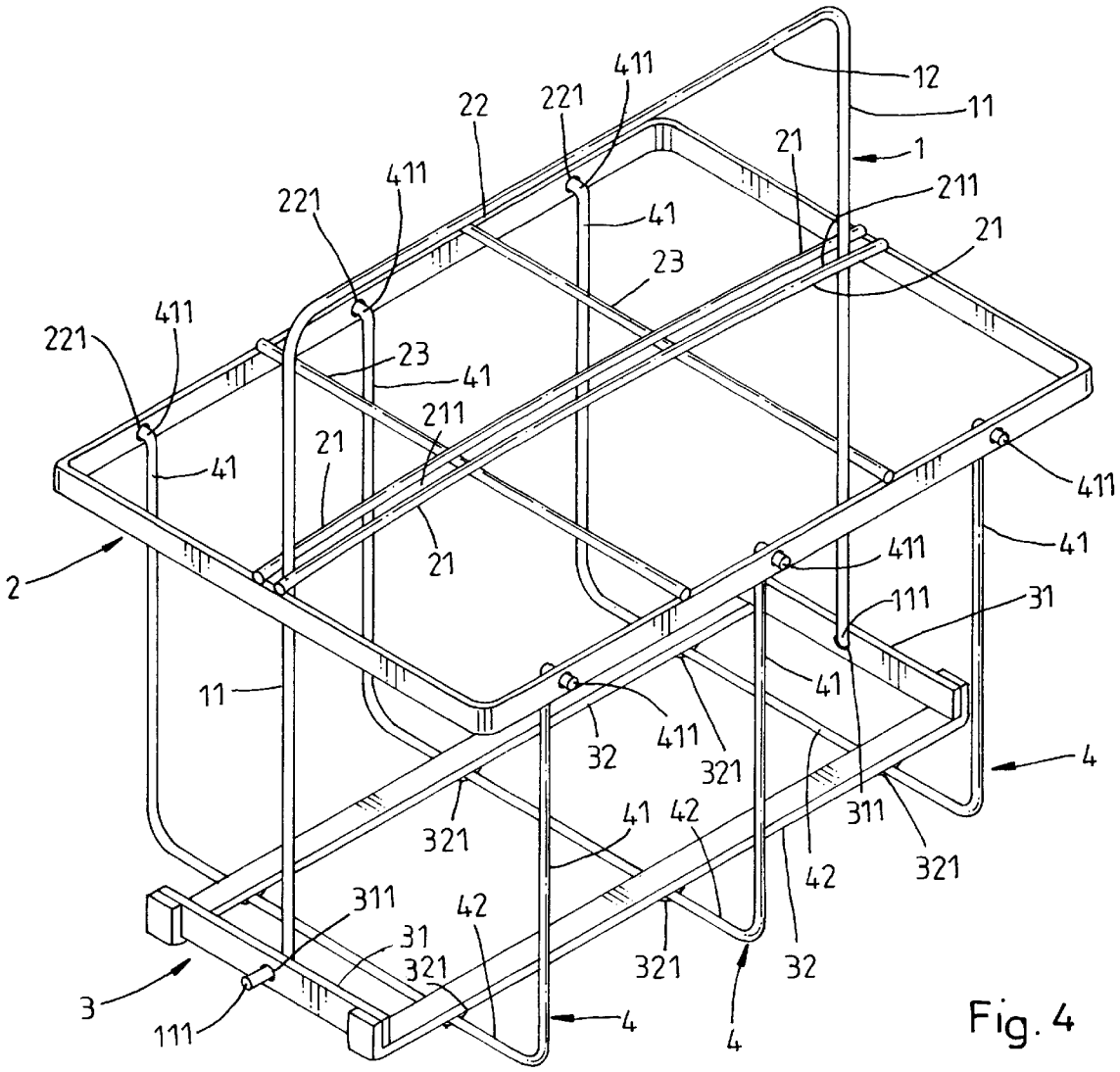
FIG. 4 is a perspective assembly view of the folding collapsible container basket according to the present invention.

Referring to FIG. 4 and FIG. 3 again, the top open frame 2 is a rectangular open frame having two longitudinal rods 21 connected between two short sides thereof on the middle in parallel to the long sides and defining a narrow, longitudinally extended gap 211, two transverse rods 23 connected in parallel between two long sides 22 thereof across the longitudinal rods 21, and a plurality of pivot holes 221 respectively symmetrically provided at the two long sides 22 thereof. The U-shaped bottom wire rods 4 are respectively pivoted to and suspended from the two long sides 22 of the top open frame 2, each comprising a horizontal middle section 42, two pivot tips 411 respectively pivoted to a respective pivot hole 221 on each of the two long sides 22 of the top open frame 2, and two vertical end sections 41 respectively connected between the two distal ends of the middle section 42 and the pivot tips 411. The bottom rack 3 is a rectangular open frame fastened to the U-shaped bottom wire rods 4 and disposed in parallel to the top open frame 2, comprising two parallel short side bars 31, the short side bars 31 each having a pivot hole 311 on the middle, two long side bars 32 connected in parallel between the short side bars 31 and respectively supported on the horizontal middle section 42 of each U-shaped bottom wire rod 4, and a plurality of locating plates 321 respectively welded to the long side bars 32 at the bottom side and defining a respective pivot hole 3211. The U-shaped bottom wire rods 4 are respectively inserted through the pivot holes 3211 in the locating plates 321 of the bottom rack 3 before fastening to the top open frame 2. The handle 1 is a U-shaped rod member comprising a middle grip 12, two pivot tips 111, and two side arms 11 connected between two distal ends of the middle grip 12 and the pivot tips 111. During assembly, the side arms 11 of the handle 1 are inserted through the gap 211 between the parallel rods 21 of the top open frame 2, and then the pivot tips 111 of the handle 1 are respectively coupled to the pivot holes 311 at the two short side bars 31 of the bottom rack 3.

Figure 5:
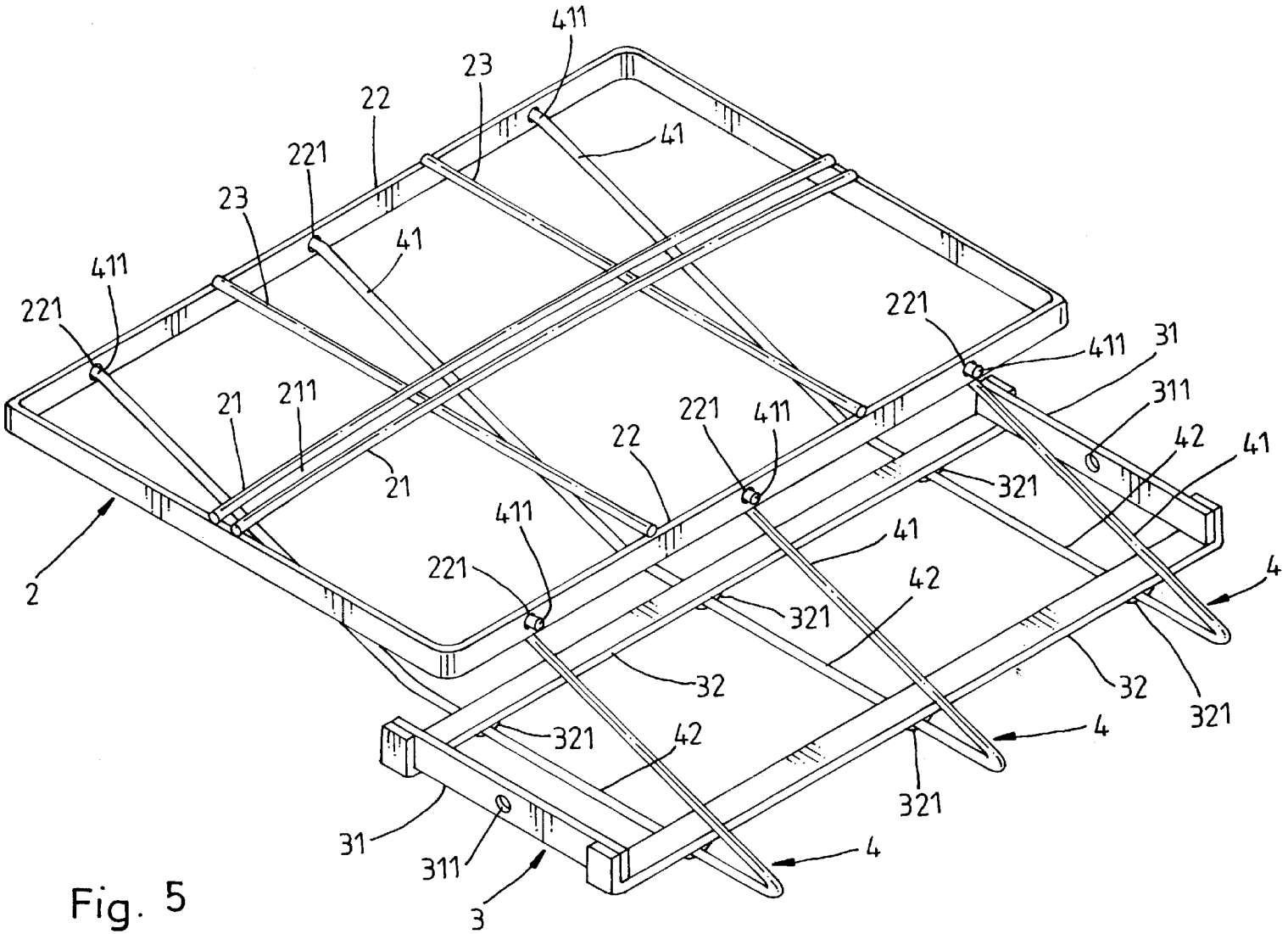
FIG. 5 illustrates the folding action of the folding collapsible container basket of the present invention after removal of the handle.
Figure 6:
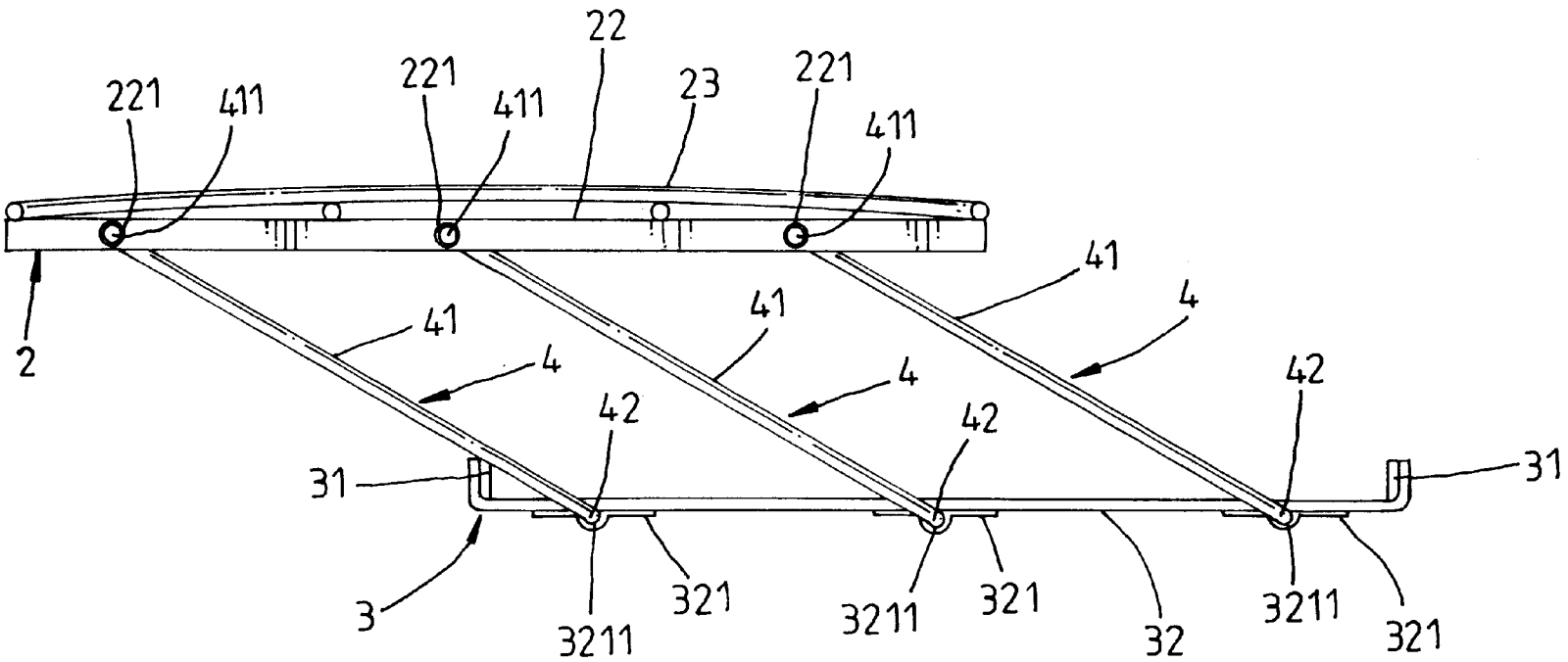
FIG. 6 is a plain view of a part of the present invention showing the U-shaped bottom wire rods folded up.
Figure 7:
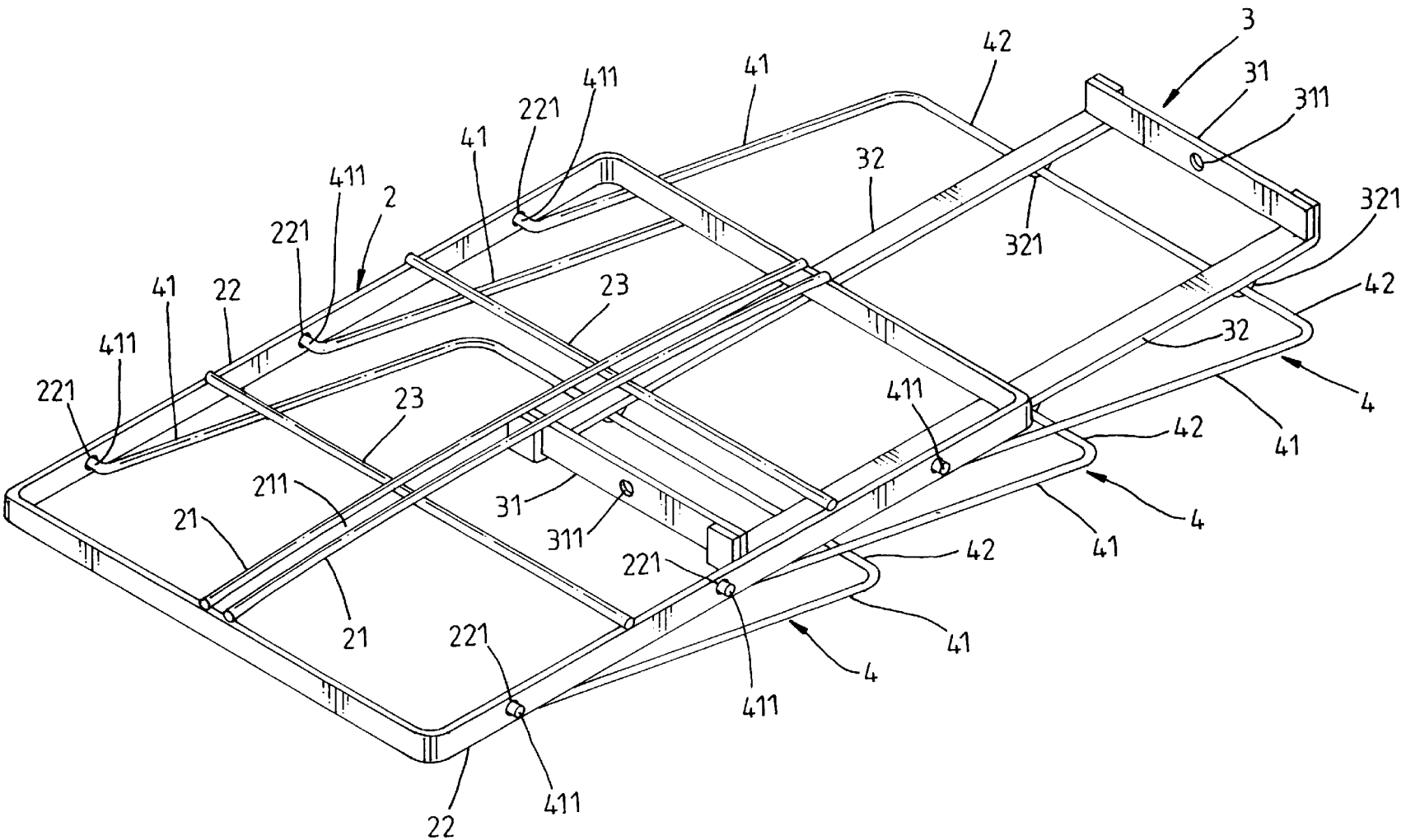
FIG. 7 shows the folding collapsible container basket of the present invention completely collapsed (the handle excluded).

Referring to FIGS. 5, 6 and 7 and FIG. 4 again, when not in use, the side arms 11 of the handle 1 are squeezed inwards toward each other to disengage the pivot tips 111 of the handle 1 from the pivot holes 311 on the short side bars 31 of the bottom rack 3, for enabling the handle 1 to be taken away from the folding collapsible basket. After removal of the handle 1, the U-shaped bottom wire rods 4 are turned upward (see FIG. 5) and closely attached with the bottom rack 3 to the top open frame 2 (see FIGS. 6 and 7) and therefore the folding collapsible container basket is collapsed and received in a flat condition as shown in FIG. 7.

While only one embodiment of the present invention has been shown and described, it will be understood that various modifications and changes could be made thereunto without departing from the spirit and scope of the invention disclosed.

What is claimed is:

1. A folding collapsible container basket comprising:

a rectangular top open frame, said top open frame comprising two parallel short sides, two parallel long sides bilaterally connected between said short sides, two longitudinal rods connected in parallel between said two short sides on the middle, a narrow, longitudinally extended gap defined between said longitudinal rods, two transverse rods connected between said long sides across said longitudinal rods, and a plurality of pivot holes respectively symmetrically provided at said two long sides;

a plurality of U-shaped bottom wire rods respectively pivoted to and suspended from the two long sides of said top open frame, said U-shaped bottom wire rods each comprising a horizontal middle section, two pivot tips respectively pivoted to a respective pivot hole on each of the two long sides of said top open frame, and two vertical end sections respectively connected between two distal ends of said horizontal middle section and the pivot tips of the respective U-shaped bottom wire rod;

a rectangular bottom rack fastened to said U-shaped bottom wire rods and disposed in parallel to said top open frame, said bottom rack comprising two parallel short side bars, said short side bars each having a pivot hole on the middle, two long side bars connected in parallel between said short side bars and respectively supported on the horizontal middle section of each of said U-shaped bottom wire rods, and a plurality of locating plates respectively welded to said long side bars at a bottom side and defining a respective pivot hole coupled to one of said U-shaped bottom wire rods; and a handle, said handle comprising an elongated middle grip, two pivot tips adapted for coupling to the pivot hole on each short side bar of said bottom rack, and two side arms connected between two distal ends of said middle grip and the pivot tips of said handle.

* * * * *